US009304527B1

(12) United States Patent
Lipka et al.

(10) Patent No.: US 9,304,527 B1
(45) Date of Patent: Apr. 5, 2016

(54) APPARATUS FOR GENERATING HIGH DYNAMIC RANGE, HIGH VOLTAGE SOURCE USING LOW VOLTAGE TRANSISTORS

(71) Applicants: Ronald Joseph Lipka, Northborough, MA (US); Akhil Garlapati, Lexington, MA (US)

(72) Inventors: Ronald Joseph Lipka, Northborough, MA (US); Akhil Garlapati, Lexington, MA (US)

(73) Assignee: Qualtre, Inc., Marlborough, MA (US)

( * ) Notice: Subject to any disclaimer, the term of this patent is extended or adjusted under 35 U.S.C. 154(b) by 40 days.

(21) Appl. No.: 13/798,361

(22) Filed: Mar. 13, 2013

Related U.S. Application Data

(60) Provisional application No. 61/776,146, filed on Mar. 11, 2013.

(51) Int. Cl.
*G05F 3/04* (2006.01)
*G05F 3/02* (2006.01)

(52) U.S. Cl.
CPC ..... *G05F 3/02* (2013.01)

(58) Field of Classification Search
USPC ..... 323/265, 268, 311, 312, 313, 314, 315, 323/316, 317; 327/530, 538, 539, 540, 54
See application file for complete search history.

(56) References Cited

U.S. PATENT DOCUMENTS

| | | | | |
|---|---|---|---|---|
| 5,801,523 | A * | 9/1998 | Bynum | 323/315 |
| 8,063,624 | B2 * | 11/2011 | Ribeiro do Nascimento et al. | 323/315 |
| 2008/0007243 | A1 * | 1/2008 | Matsumoto et al. | 323/313 |
| 2012/0256613 | A1 * | 10/2012 | Bellaouar et al. | 323/314 |
| 2014/0125404 | A1 * | 5/2014 | Kumar et al. | 327/537 |

* cited by examiner

*Primary Examiner* — Nguyen Tran
(74) *Attorney, Agent, or Firm* — Burns & Levinson LLP; Bruce D. Jobse

(57) ABSTRACT

The present disclosure provides a varying high voltage source implemented with low voltage domain electronic components that are less costly to manufacture. According to one aspect, the present disclosure provides a high voltage circuit apparatus comprising a pull up resistance module, a plurality of cascode cell stages, a first of the cascode cell stages being coupled to the pull up resistance module, a low voltage domain current sink module coupled to a last of the cascode cell stages, and a clamping voltage source coupled to the last of the cascode cell stages. The circuit apparatus is devoid of high-voltage transistor components.

12 Claims, 4 Drawing Sheets

APPARATUS FOR GENERATING HIGH DYNAMIC RANGE, HIGH VOLTAGE SOURCE USING LOW VOLTAGE TRANSISTORS

TECHNICAL FIELD

The present disclosure relates to high-voltage circuitry and, more particularly, to a high voltage circuit and a varying-voltage system that are constructed using low-voltage electronic components.

BACKGROUND

In a high-voltage circuit and/or system, a varying voltage may be needed that can vary over a wide range of high-voltage domain, for example, from ground to a high supply voltage. Traditionally, a high voltage power source requires high voltage electronic components, such as high-voltage MOSFETs. The fabrication of high-voltage electronic components, however, tend to be very costly due to the extra mask and the die area required. Moreover, high-voltage electronic components are more prone to failure due to the high operating voltage.

Accordingly, in a variety of applications, a need exists for a varying voltage source with a high dynamic range that is simpler and less costly to manufacture.

Another need exists for a varying voltage source with a high dynamic range that can be constructed of components that are less susceptible to failure, such as low voltage domain electronic components, as low voltage transistors are more susceptible.

SUMMARY

The present disclosure provides a varying high voltage source apparatus implemented with low voltage domain electronic components, that are less costly to manufacture, is devoid of high-voltage transistor components. More specifically, disclosed is a varying high voltage source implemented with a current sink to ground that is connected to a pull-up resistor to the high voltage power supply, which is beyond prior technology limit. The disclosed high voltage circuit apparatus comprises a pull up resistance module, a low voltage domain current mirror module, and a plurality of cascode cell stages coupled intermediate there between. A first of the cascode cell stages is coupled to the pull up resistance module, while a last of the cascode cell stages is coupled to the low voltage domain current mirror module. A clamping voltage source is also coupled to the last of the cascode cell stages. The voltage source can vary by programming the current of the current sink so that the output voltage is a voltage drop below the high voltage power supply. The current sink is protected with cascode cells to limit the voltage levels seen across the terminals of each transistor. The number of cascode cells that are used may be determined by the voltage difference between the low and high voltage power supplies. In the present disclosure, the current sink is constructed with the lowest voltage transistors available for slightly higher dynamic range and reduced 1/f noise, which is a concern for system utilizing a high voltage source.

The resistors can withstand voltages beyond prior technology limits, but typically current sources cannot because they are built with MOSFETs that will experience time dependent dielectric breakdown and/or hot carrier effects if the terminal voltages are too high.

The voltage source dynamic range is made to be nearly as much as the entire high voltage power rail (to ground) by using a parallel biasing leg for the cascode stages that tracks with the main current sink. Additionally, a voltage clamp is included to maintain the proper voltage across the low voltage current sink while programming the output voltage throughout its full dynamic range.

According to one aspect, the present disclosure provides a high voltage circuit apparatus comprising a pull up resistance module, a plurality of cascode cell stages, a first of the cascode cell stages being coupled to the pull up resistance module, a low voltage domain current mirror module coupled to a last of the cascode cell stages, and a clamping voltage source coupled to the last of the cascode cell stages. The circuit apparatus is devoid of high-voltage transistor components.

According to another aspect, the present disclosure provides a programmable high voltage circuit comprising a current branch, a pull up resistance module coupled to the current branch to provide a output voltage, a bias branch coupled to the pull up resistance module, and a low voltage current mirror coupled to the current branch and the bias branch. The programmable high voltage circuit is devoid of high-voltage transistor components.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
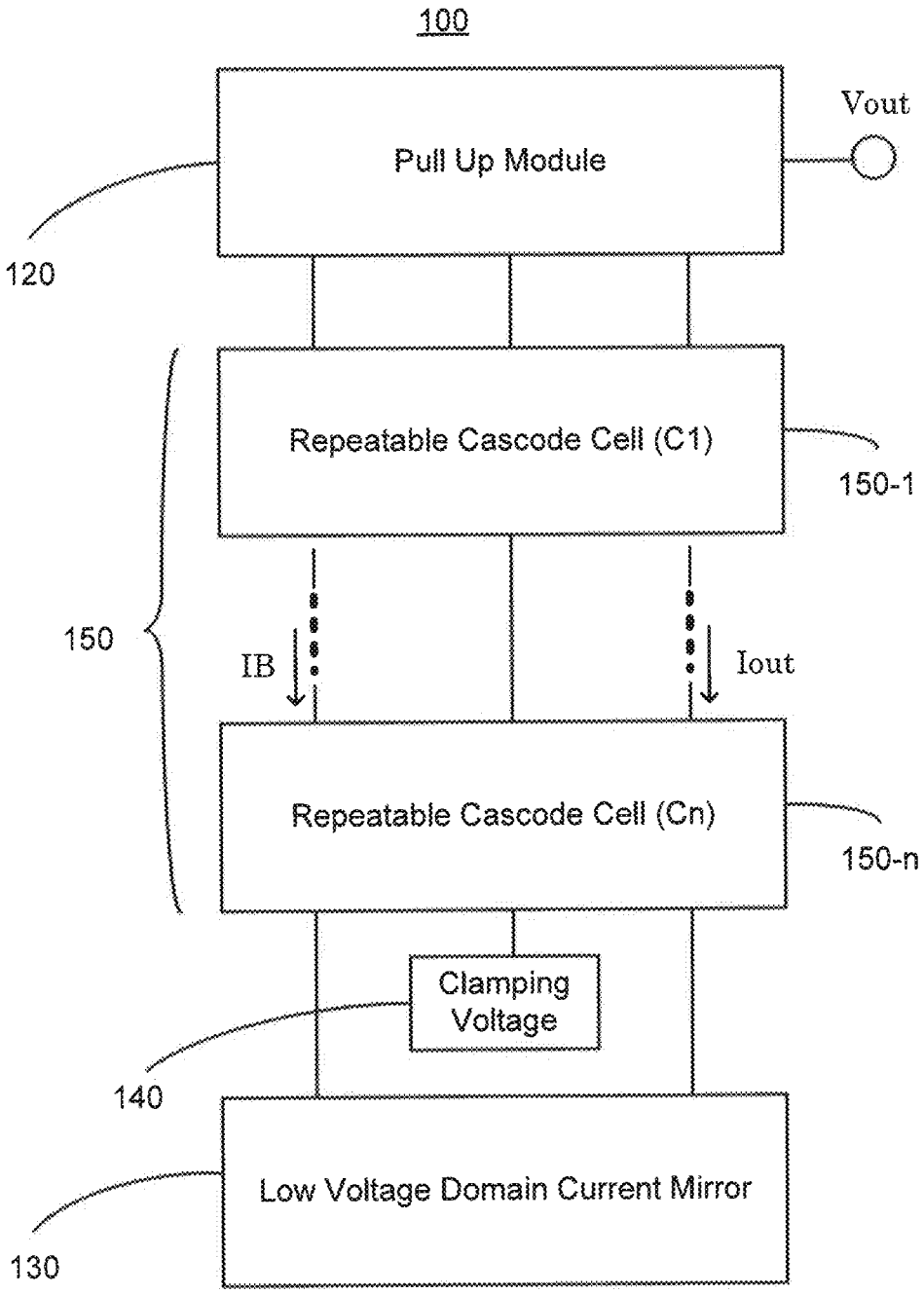
FIG. 1 is a schematic diagram illustrating an apparatus for generating high dynamic range, high voltage source in accordance with an embodiment of the present disclosure.

FIG. 1 is a block diagram illustrating the functional components of high voltage source apparatus 100 for generating high dynamic range. As illustrated, apparatus 100 comprises one or more cascode cells 150 (or 150-1 through 150-n) interconnected between a pull up resistance module 120, which provides an output voltage to an output terminal Vout, and a low voltage domain current mirror (or current sink) 130, as illustrated. A clamping voltage source 140 is coupled to the last cell 150-n of the cascode cells 150. FIGS. 2, 3, 4, and 5, demonstrate exemplary implementations of each of components 120, 130, 140 and 150, respectively, while FIG. 6 is a circuit schematic illustrating schematically the interconnections among components 120, 130, 140 and 150 of apparatus 100. Low voltage current mirror 130 generates an output current Iout that generates Vout and a parallel bias leg current IB.

Figure 2:
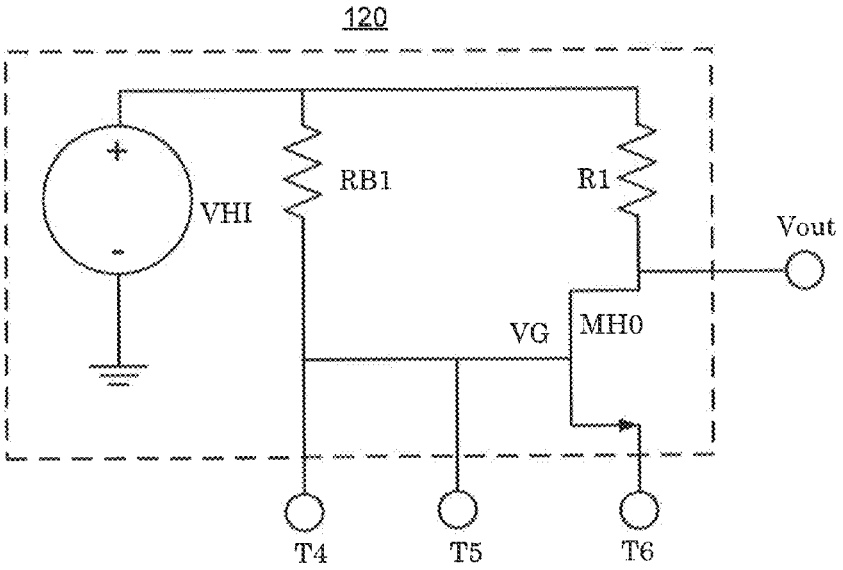
FIG. 2 illustrates a schematic circuit of a pull up resistance module for the apparatus of the present disclosure.

FIG. 2 illustrates schematically an exemplary implementation of a pull up resistance circuit 120 in accordance with the present disclosure. In one embodiment, pull up resistance circuit 120 comprises a high voltage source VHI, a bias resistor RB1, a main resistor R1, and a transistor MH0. As shown, a first end of main resistor R1 and a first end of bias resistor RB1 are coupled together to high voltage source VHI. A second end of main resistor R1 is coupled to a drain of transistor MH0 and output terminal Vout. A second end of bias resistor RB1 is coupled to a gate of transistor MH0, which may be coupled to terminals T4 and T5 and have a common gate voltage VG. A source terminal of transistor MH0 may be coupled to terminal T6. In one embodiment, high voltage source VHI may supply a voltage of about 20 volts. In one embodiment, transistor MH0 may be an n-type MOSFET.

Figure 3:
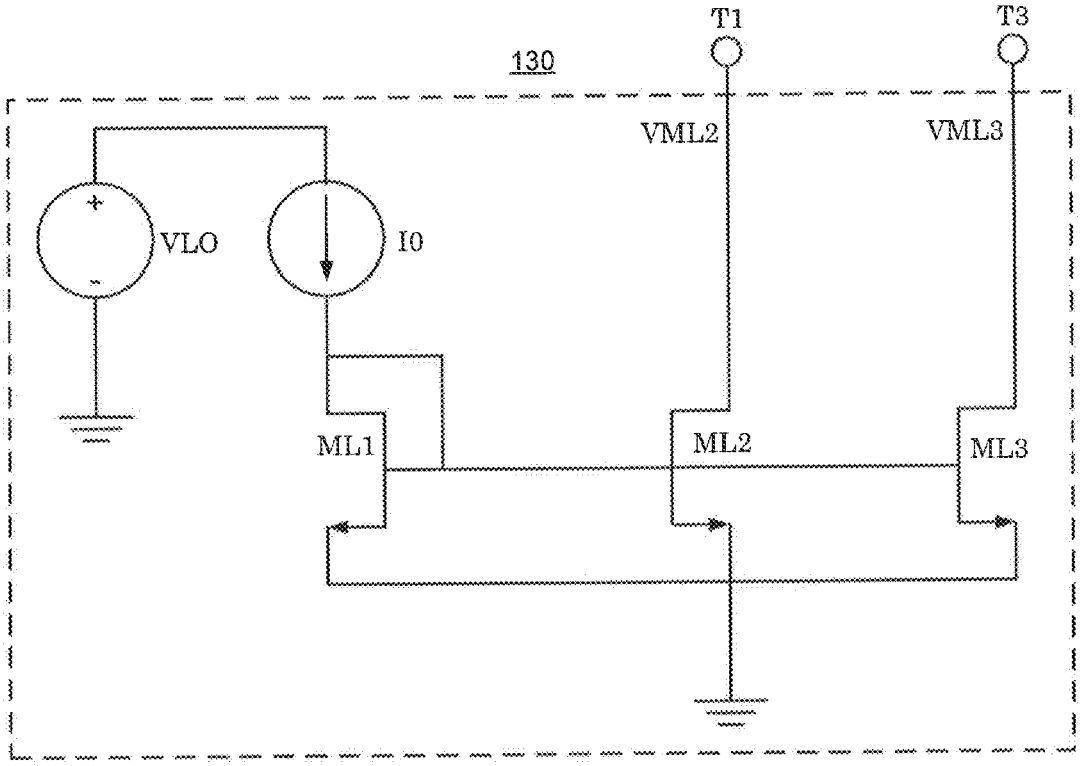
FIG. 3 illustrates a schematic circuit of a low voltage domain current sink for the apparatus of the present disclosure.

FIG. 3 illustrates schematically an exemplary implementation of a low voltage domain current mirror 130 in accordance with the present disclosure. In one embodiment, low voltage domain current mirror 130 constitutes two branches of current mirrors and comprises a low voltage source VLO or a reference current I0, and transistors ML1, ML2, and ML3. Voltage source VLO or reference current I0 is applied to a drain of transistor ML1, which is shorted to a gate of transistor ML1, such that transistor ML1 is operated in the saturation region. Gates of transistors ML1, ML2, and ML3 are coupled with each other, and sources of transistors ML1, ML2, and ML3 are all coupled to the ground. As a result, a first branch of current mirror is formed at a terminal T1 with a node voltage of VML2, and a second branch of current mirror is formed at a terminal T3 with a node voltage of VML3.

Figure 4:
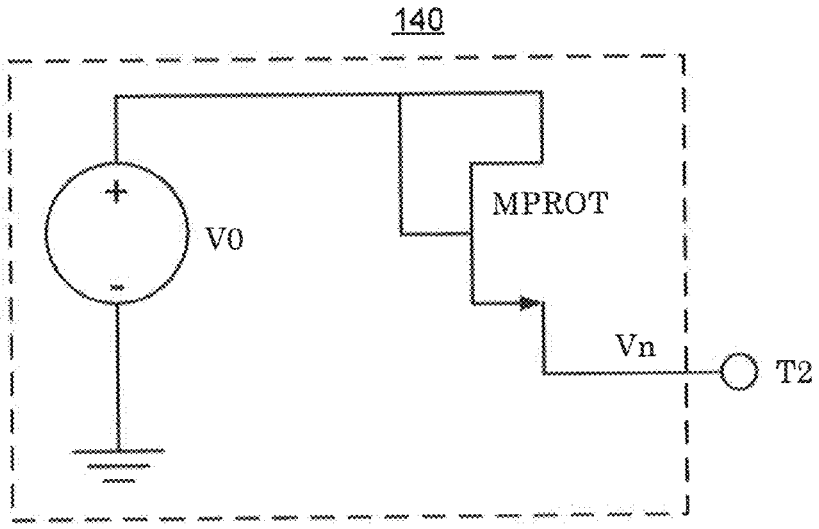
FIG. 4 illustrates a schematic circuit of a voltage source for the apparatus of the present disclosure.

FIG. 4 illustrates schematically an exemplary implementation of a clamping voltage source 140 in accordance with the present disclosure. In one embodiment, clamping voltage source 140 comprises a voltage source V0 and a transistor MPROT. A drain of transistor MPROT is shorted to a gate of transistor MPROT, such that transistor MPROT is operated in the saturation region. In one embodiment, transistor MPROT is a zero threshold voltage native NMOS transistor and thus can source or sink current to maintain a clamping voltage Vn close to V0 as Vout and VG are programmed. In one embodiment voltage V0 may be about 1.2 volts.

Figure 5:
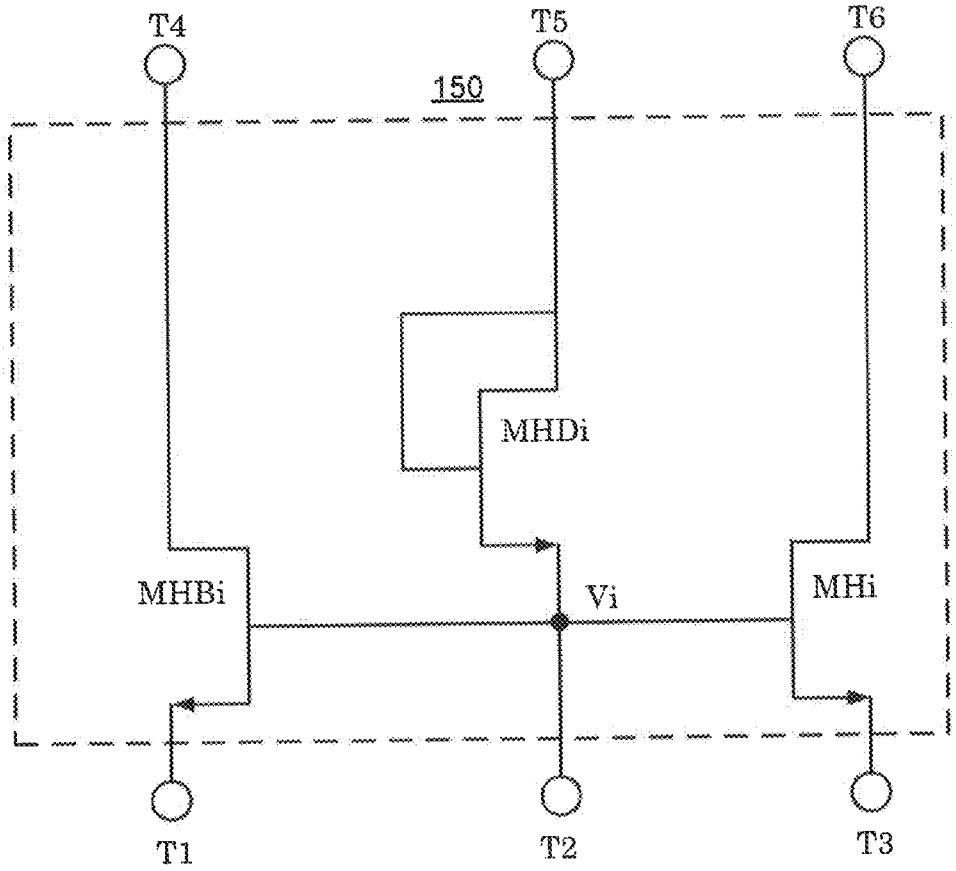
FIG. 5 illustrates a schematic circuit of a repeatable cascode cell for the apparatus of the present disclosure.
Figure 6:
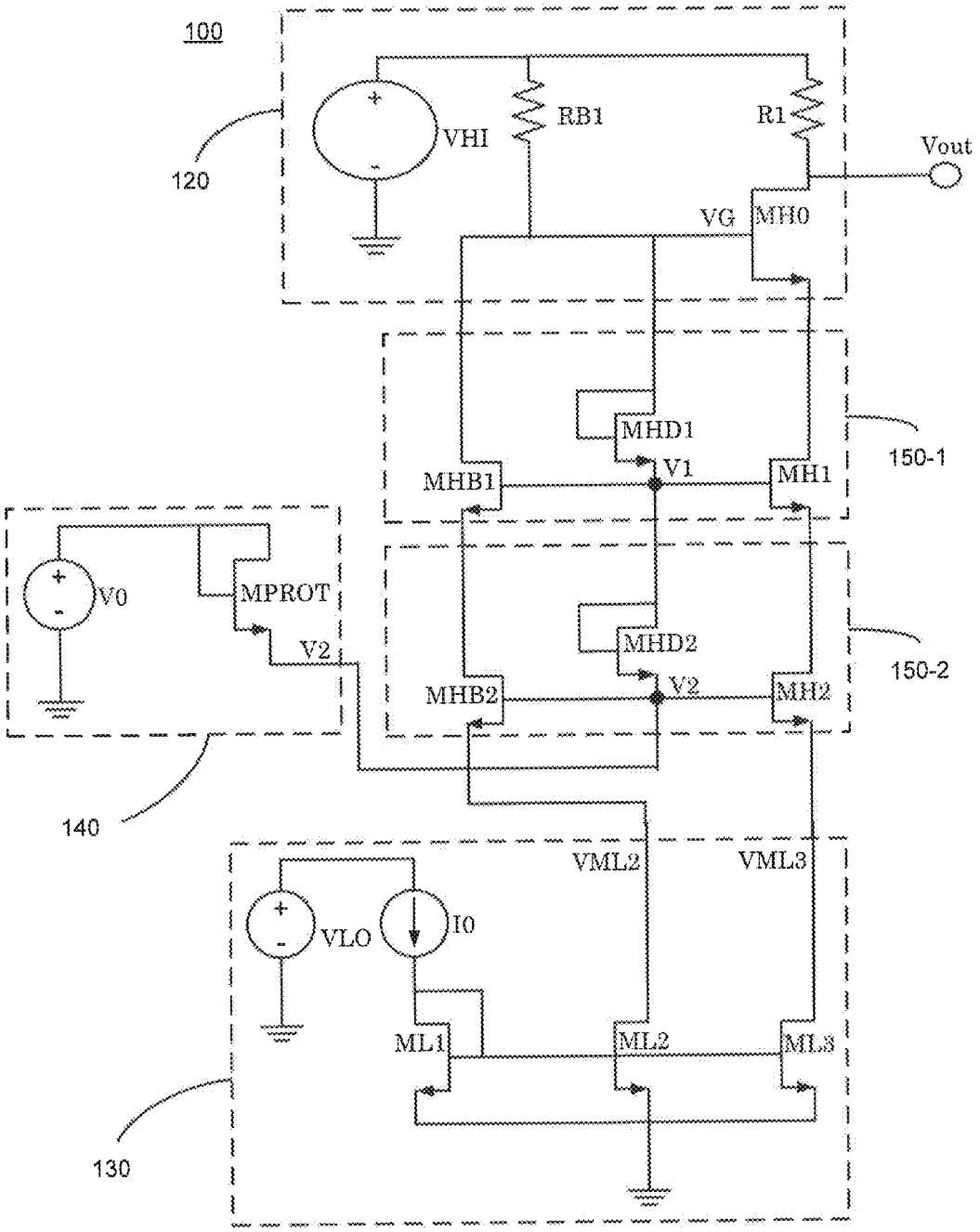
FIG. 6 illustrates a schematic circuit of a high voltage apparatus comprising two cascade cells in accordance with an embodiment of the present disclosure.

FIG. 5 illustrates a schematic circuit of a repeatable cascode cell 150 for the apparatus of the present disclosure. As shown in FIG. 1, a plurality of repeatable cascode cells 150-1 though 150-n may be coupled in series or "stacked" on top of each other. For illustrative purposes, FIG. 5 only shows the i-th cell of the repeatable cascode cells 150. Repeatable cascode cell 150 is suitable for use in any of the cascode stages in apparatus 100. In one embodiment, repeatable cascode cell 150 comprises transistors MHBi, MHDi, and MHi. Drains of transistors MHBi, MHDi, and MHi are respectively coupled to terminals T4, T5, and T6. Sources of transistors MHBi, MHDi, and MHi are respectively coupled to terminals T1, T2, and T3. The source of transistor MHDi is coupled to gates of transistors MHBi and MHi, and the drain of transistor MHDi is shorted to a gate of transistor MHDi. In one embodiment, when the i-th repeatable cascode cell 150-i is stacked on the j-th repeatable cascode cell 150-j, terminals T1, T2, and T3 of repeatable cascode cell 150-i are respectively coupled to terminals T4, T5, and T6 of repeatable cascode cell 150-j.

FIG. 6 illustrates a schematic circuit of a high voltage apparatus 100 comprising two repeatable cascode cells in accordance with an embodiment of the present disclosure. As shown, high voltage source apparatus 100 comprises a pull up resistance module 120, a first cascode cell 150-1 coupled with pull up resistance module 120, a second cascode cell 150-2 coupled with first cascode cell 150-1, a clamping voltage source 140 coupled with a second terminal of second cascode cell 150-2, and a low voltage domain current mirror 130 coupled with a first terminal and a third terminal of second cascode cell 150-2. Details of pull up resistance module 120, low voltage domain current mirror 130, clamping voltage source 140, and each of cascode cells 150-1 and 150-2 are respectively shown in FIGS. 2, 3, 4, and 5, and described above.

Referring now to FIGS. 1-6, output voltage Vout from apparatus 100 may be programmed in accordance with reference current I0 of current mirror 130. In one embodiment, as reference current I0 is varied, output current Iout varies and hence output voltage Vout will vary. Additionally, parallel bias leg current IB varies with output current Iout so that node voltage VG tracks up or down to maintain the proper voltages across the terminals of transistor MH0 of pull up resistance module 120, and across the terminals of transistors MHB1, MHD1, and MH1 of cascode cell 150-1.

Transistor MH0 of pull up resistance module 120 is the main output current leg that generates output voltage Vout. Transistor MHB1 of cascode cell 150-1 is the bias leg that generates node voltage VG. The diode connected transistor MHD1 determines the voltage drop for cascode cell 150-1. Similarly, transistor MHD2 determines the voltage drop for cascode cell 150-2. Transistors MHD1 and MHD2 can be built with multiple diode connected transistors in series to give more voltage drop per cascode cell. The difference between high voltage VHI and low voltage VLO determines how many cascode cells are stacked on top of each other. The number of cascode cells 150 used in circuit 100 may be determined by taking the high limit range of the voltage source, typically a direct current voltage source, and dividing it by the low voltage limit performance parameter of the transistor components used within the cascode cells. The resulting number approximates the number of cascode cells or stages required, however, for optimal performance, at least one additional cascode cell may be included in the series or stack of cascode cells. For example, in one embodiment, each cascode cell stack may correspond to a voltage drop of about 3.0~4.0 volts/stack. For example, in one embodiment, high voltage VHI may be 20.0 volts and low voltage VLO may be 3.0 volts. As such, a stack of seven cascode cells 150 may be required in apparatus 100. Note that all of transistors ML1, ML2, ML3, MH0, MHB1, MHD1, MH1, MHB2, MHD2, MH2, and MPROT in apparatus 100 are low voltage devices. In the embodiment disclosed in FIG. 6, transistors ML3, MH2, MH1, and MH form a first current source or rail which enables programming the full range of Vout via a main resistor R1 while transistors ML2, MHB2, and MHB1 act as a second current source or rail which mirrors the first current source.

In one embodiment, transistor MPROT of clamping voltage source 140 provides a node voltage V2 so as to ensure that node voltages VML2 and VML3 do not fall to low or go to high throughout the full programmable range of Vout. If node voltages VML2 and VML3 become too low, transistors ML2 and ML3 would not have enough drain to source voltage to keep them in the saturation region which would decrease parallel bias leg current IB and output current Iout, respectively. If node voltages VML2 and VML3 become too high, the drain to source voltages of transistors ML2 and ML3, respectively, could exceed the technology limits.

As output current Iout is programmed from its minimum to maximum current value, output voltage Vout tracks this programming and changes from its maximum to minimum voltage value. Accordingly, the cascode stages successively collapse (i.e., the cascode stages change from a high output impedance cascode stage to a low impedance pass through stage). However, throughout the programmable range, current source I0 of current mirror 130 does not collapse and continues to function as a high impedance current source. This enables output voltage Vout to change linearly from maximum to minimum voltage values across a very wide voltage range.

In light of the foregoing, the reader can appreciate that the disclosed apparatus and method can save on production costs, since additional high voltage technology masks are not needed in the component manufacturing process. Although the apparatus of the present disclosure provides a DC high voltage source, in certain embodiments, the apparatus of the present disclosure may provide an AC high voltage source. It is to be understood that the above-described embodiments are merely illustrative of some of the many specific embodiments that represent applications of the principles discussed above. Clearly, numerous and other arrangements can be readily devised by those skilled in the art without departing from the scope of the invention.

What is claimed is:

1. A high voltage circuit apparatus comprising:

a pull up resistance module including a high voltage source and an output to provide an output voltage;

a plurality of cascode cell stages coupled to one another, a first of the cascode cell stages being coupled to the pull up resistance module;

wherein each of the cascode cell stages comprises:

an output current leg having a first end and a second end;

a bias current leg having a first end and a second end; and a voltage drop leg having a first end and a second end and a voltage drop element coupled between the first and second ends of the voltage drop leg;

a low voltage domain current mirror module coupled to the second end of the output current leg of a last of the cascade cell stages and coupled to the second end of the bias current leg of the last cascode cell stage; and a clamping voltage source module comprising a voltage source and a zero threshold voltage native transistor having a source node coupled to the voltage drop leg second end of the last of the cascode cell stages, and a gate node and drain node shorted together and coupled to an output of the voltage source, wherein the circuit apparatus is devoid of high-voltage transistor components.

2. The apparatus of claim 1, wherein the voltage drop element comprises one or more diode connected transistors.

3. The apparatus of claim 1, wherein a node of the zero threshold voltage native transistor of the clamping voltage module is coupled to a node of the voltage drop element.

4. The apparatus of claim 1, wherein the low voltage domain current mirror module comprises a first current mirror and a second current mirror.

5. The apparatus of claim 4, wherein the first current mirror is coupled to the second end of the bias current leg of the last cascode cell stage and the second current mirror is coupled to the second end of the output current leg of the last cascode cell stage.

6. The apparatus of claim 1, wherein the pull up resistance module comprises a pull up resistor having a first end coupled to the high voltage source for providing an output voltage at a second end of the pull up resistor; and a bias resistor having a first end coupled to the high voltage source.

7. The apparatus of claim 6, wherein a second end of the bias resistor is coupled to the first end of the bias current leg of a first cascode cell stage and is coupled to the first end of the voltage drop leg of the first cascode cell stage.

8. A programmable high voltage circuit comprising:

an output current branch having a first end and a second end;

a pull up resistance module coupled to the first end of the output current branch to provide an output voltage;

a bias current branch having a first end coupled to the pull up resistance module and to gate node of a transistor in the pull up resistance module having a source node coupled to the first end of the output current branch;

a low voltage current sink module coupled to a second end of the output current branch and a second end of the bias current branch;

a voltage drop branch having a first end coupled to the first end of the bias current branch; and a clamping voltage source module comprising a voltage source coupled to a zero threshold voltage native transistor having a source node coupled to a second end of the voltage drop branch to maintain a clamping voltage for the voltage drop branch;

wherein the programmable high voltage circuit is devoid of high-voltage transistor components.

9. The apparatus of claim 8, wherein the voltage drop branch comprises a plurality of voltage drop elements coupled in series with one another, each voltage drop element comprising one or more diode connected transistors.

10. The apparatus of claim 8, wherein the low voltage current sink module comprises a first current mirror coupled to the second end of the output current branch and a second current mirror coupled to the second end of the bias current branch.

11. The apparatus of claim 1, wherein the plurality of cascode cell stages comprises m cell stages, $m>1$, and wherein for each cell stage j, $1<j\leq m$:

an output current leg first end (j) is coupled to an output current leg second end (j−1);

a bias current leg first end (j) is coupled to a bias current leg second end (j−1); and a voltage drop leg first end (j) is coupled to a voltage drop leg second end (j−1).

12. The apparatus of claim 1, wherein a range of output voltage values between a maximum value and a minimum value is a function of a number of the plurality of cascode cell stages.

* * * * *